US010428396B2

(12) United States Patent
Soni et al.

(10) Patent No.: US 10,428,396 B2
(45) Date of Patent: Oct. 1, 2019

(54) METHOD FOR THE PREPARATION OF HIGH TEST MOLASSES

(71) Applicant: PRAJ INDUSTRIES LIMITED, Pune (IN)

(72) Inventors: Ajaykumar Chhaganlal Soni, Pune (IN); Sandip Vishnu More, Pune (IN); Mahesh Devidas Badgujar, Pune (IN)

(73) Assignee: PRAJ INDUSTRIES, LIMITED, Pune, IN (US)

( * ) Notice: Subject to any disclaimer, the term of this patent is extended or adjusted under 35 U.S.C. 154(b) by 0 days.

(21) Appl. No.: 15/747,945

(22) PCT Filed: Jul. 21, 2016

(86) PCT No.: PCT/IN2016/050245

§ 371 (c)(1),
(2) Date: Jan. 26, 2018

(87) PCT Pub. No.: WO2017/021979

PCT Pub. Date: Feb. 9, 2017

(65) Prior Publication Data

US 2018/0223382 A1 Aug. 9, 2018

(30) Foreign Application Priority Data

Aug. 3, 2015 (IN) ..... 2928/MUM/2015

(51) Int. Cl.

| | |
|---|---|
| ***C13B 50/00*** | (2011.01) |
| ***C13B 20/00*** | (2011.01) |
| ***C13B 25/00*** | (2011.01) |
| ***C13B 35/02*** | (2011.01) |
| ***C13K 11/00*** | (2006.01) |
| ***C13B 30/00*** | (2011.01) |
| ***C13K 3/00*** | (2006.01) |

(52) U.S. Cl.

CPC ..... *C13B 50/006* (2013.01); *C13B 20/005* (2013.01); *C13B 25/00* (2013.01); *C13B 30/002* (2013.01); *C13B 35/02* (2013.01); *C13K 3/00* (2013.01); *C13K 11/00* (2013.01)

(58) Field of Classification Search

None

See application file for complete search history.

(56) References Cited

U.S. PATENT DOCUMENTS 4,332,622 A * 6/1982 Hohnerlein, Jr. ..... C13K 3/00 127/41

FOREIGN PATENT DOCUMENTS

RU 2187230 C1 * 8/2002
WO WO-2015049345 A1 * 4/2015 ..... C08H 8/00

OTHER PUBLICATIONS

RU-2187230-C1, English translation (Year: 2002).*
K-Patents, process instruments Jan. 2, 2003 (Year: 2003).*
Chen, et al., "Cane sugar handbook: a manual for cane sugar manufacturers and their chemists", No. Ed. 12. John Wiley and Sons, Inc., 1993, 428: para [10.57].
Notification of Transmittal of the International Search Report and the Written Opinion of the International Searching Authority, or the Declaration for PCT/IN2016/050245, dated Dec. 13, 2016, 9 pages.
Notification of Transmittal of the International Search Report and the Written Opinion of the International Searching Authority, or the Declaration for PCT/IN2016/050245, dated Dec. 12, 2016.

* cited by examiner

*Primary Examiner* — Melvin C. Mayes
*Assistant Examiner* — Stefanie J Cohen
(74) *Attorney, Agent, or Firm* — Billion & Armitage; Benjamin C. Armitage

(57) ABSTRACT

The invention relates to a method the preparation of an inverted sugar product, called high test molasses, using novel reaction parameters. More particularly it relates to the preparation of high-test molasses using an acid wherein the loss of sugar due to use of acid and high temperature as in conventional method is eliminated.

11 Claims, No Drawings

METHOD FOR THE PREPARATION OF HIGH TEST MOLASSES

FIELD OF THE INVENTION

The invention relates to a method for the preparation of an inverted sugar product, called high test molasses, using novel reaction parameters. More particularly it relates to the preparation of high-test molasses using an acid wherein the loss of sugar due to use of acid and high temperature as in conventional method is eliminated.

BACKGROUND

High test molasses [HTM] is made from the sugarcane syrup [optionally also from sugar beet syrup], after removing impurities and concentrating it in boiler up to 85° Brix value. Sucrose in the high test molasses is partially inverted with enzymes or acids to glucose and fructose. It is necessary to invert the sucrose to avoid it being crystallized or solidified in the storage tanks at high concentrations. The composition of high test molasses differs from the traditional molasses and because of their higher sugar content, it is used mainly for production of alcohol. Due to their sweetness and liquid form, high test molasses is also utilized in food, baking and pharmaceutical industries. The shelf life of it is about six months, depending on storage and climatic conditions. Further such inverted sugar provides more powerful preserving qualities (a longer shelf life) to products that use it. Traditionally, inverted sugar is produced from sucrose using mineral acids like $H_2SO_4$ and HCl. This conventional method is corrosive, has low conversion efficiency, with more sugar loss. Further the obtained inverted sugar is darker in colour due to caramelisation of sugar during the process. The use of invertase enzyme has disadvantages of enzyme inactivation due to substrate contamination and cost. Therefore there is need to provide an improved method with less sugar lose and being economic. Herein this is achieved by using a mild acid treatment for partial inversion of sugarcane syrup; further said treatment is non-corrosive and non-degrading with much less sugar loss and the ease of unit operation.

The present invention provides a method for preparation of high test molasses from sugarcane syrup that is much efficient in terms of sugar recovery and the quality of the final product. Further the method has several advantages over the conventional methods, further providing economic advantages to the use of the disclosed invention.

DETAILED DESCRIPTION OF THE INVENTION

High test molasses or inverted sugarcane syrup is prepared from concentrated sugarcane syrup, which is obtained by evaporation of sugarcane juice. The high test molasses is heavy, partially inverted cane syrup (no sugar is yet removed) having Brix value of about 85°. High-test molasses is used largely in distillery and as a commercial sweetener or in animal feed. High-test molasses is clear to light brown in colour. Generally composition of high test molasses is dependent on the cane juice from which it is made. A typical composition of HTM is as follows:

| Parameter | Value |
|---|---|
| Brix | 85° |
| Sucrose | 21% w/v |
| Inverted sugar | 55% w/v |
| Total sugars | 76% w/v |

In the earlier years, sulphuric acid was used for the preparation of HTM where about 3 to 5% of the sugar was destroyed due to high temperature of the reaction in the presence of strong acid like sulphuric acid. The present invention provides a method for the preparation of high test molasses from sugarcane syrup that is much efficient in terms of sugar recovery and quality of the final product.

In one of the embodiment of the present invention, sugarcane syrup having between about 35% to about 50% sucrose by weight is used as a starting material. Said syrup is mixed with between about 0.1% to about 1.0% by weight of methane sulphonic acid [a mild organic acid]. Then reaction mixture is heated to between about 75° C. to about 95° C. for about 1 hour to about 4 hours. Next, said reaction mass is cooled to room temperature and then analysed by high performance liquid chromatography to check the sugar composition. Final high test molasses contained between about 47% to about 55% total sugar by weight having about 30% to 45% inverted sugar by weight. The inversion efficiency obtained at the end of reaction is between about 90% of theoretical maximum value at the higher MSA concentration of about 0.7% by weight.

Examples provided below give wider utility of the invention without any limitations as to the variations that may be appreciated by a person skilled in the art. A non-limiting summary of various experimental results is given in the examples, which demonstrate the advantageous and novel aspects of the method of using methane sulphonic acid for the preparation of high test molasses.

Example 1

A batch of about 100 mL of concentrated cane syrup having about 53% total sugar by weight was used as the feedstock, which contained about 47% sucrose by weight and about 3.6% inverted sugar by weight. The initial pH of said syrup was about 5. This syrup was mixed with about 0.135 mL (0.25% by weight) of sulphuric acid and treated at about 90° C. in a water bath for about 1 h to allow inversion of sucrose to inverted sugar. Next, the reaction mass [treated syrup] was cooled to room temperature and analysed by HPLC to check the sugars. The composition was found to be about 53% total sugar by weight, about 29% sucrose by weight and about 12.3% glucose by weight plus about 11.4% fructose by weight, i.e., about 23.7% inverted sugar by weight. The pH of this high test molasses was about 3. This method afforded about 45% inversion of sucrose.

Example 2

A batch of about 100 mL of concentrated cane syrup having about 53% total sugar by weight was used as the feedstock, which contained about 47% sucrose by weight and about 3.6% inverted sugar by weight. The initial pH of said syrup was about 5. This syrup was mixed with about 0.16 mL (0.25% by weight) of methane sulphonic acid and was treated at about 90° C. in a water bath for about 1 h to allow inversion of sucrose to inverted sugar. Next, the reaction mass [treated syrup] was cooled to room temperature and analysed by HPLC to check the sugars. The composition was found to be about 52% total sugar by weight, about 43% sucrose by weight and about 3.2% glucose by weight plus about 3% fructose by weight, i.e., about 6.1% inverted sugar by weight. The pH of this high test molasses was about 3. This method afforded about 12% inversion of sucrose.

Example 3

A batch of about 100 mL of concentrated cane syrup having about 47% total sugar by weight was used as the feedstock, which contained about 39% sucrose by weight and about 9% inverted sugar by weight. The initial pH of said syrup was about 5. This syrup was mixed with about 0.13 mL (0.20% by weight) of methane sulphonic acid and was treated at about 90° C. in a water bath for about 3 h to allow inversion of sucrose to inverted sugar. Next, the reaction mass [treated syrup] was cooled to room temperature and analysed by HPLC to check the sugars. The composition was found to be about 46% total sugar by weight, about 28% sucrose by weight and about 8.5% glucose by weight plus about 9% fructose by weight, i.e., about 17.5% inverted sugar by weight. The pH of this high test molasses was about 3. This method afforded about 38% inversion of sucrose.

Example 4

A batch of about 100 mL of concentrated cane syrup having about 48% total sugar by weight was used as the feedstock, which contained about 39% sucrose by weight and about 9% inverted sugar by weight. The initial pH of said syrup was about 5. This syrup was mixed with about 0.2 mL (0.30% by weight) of methane sulphonic acid and was treated at about 90° C. in a water bath for about 3 h to allow inversion of sucrose to inverted sugar. Next, the reaction mass [treated syrup] was cooled to room temperature and analysed by HPLC to check the sugars. The composition was found to be about 48% total sugar by weight, about 21% sucrose by weight and about 12% glucose by weight plus about 13% fructose by weight, i.e., about 25% inverted sugar by weight. The pH of this high test molasses was about 3. This method afforded about 52% inversion of sucrose.

Example 5

To determine the effect of different concentrations of methane sulphonic acid [MSA] on conversion efficiency of sucrose to inverted sugar, about 100 mL of cane syrup having about 51% total sugar by weight comprising about 40% sucrose by weight and about 9% inverted sugar by weight was used. Initial pH of said syrup was about 5. This syrup was mixed with different concentrations of methane sulphonic acid and was allowed to react under stirring carried at about 90° C. using a water bath for about 2 h to prepare high test molasses. The reaction mass [treated syrup] was cooled and analysed by HPLC to check the amounts for inverted sugar in different test samples. The composition of high test molasses varied depending on the amount of MSA used for the treatment as given in the Table 1 below.

TABLE 1

| Amount of MSA | Sucrose (g) | Glucose (g) | Fructose (g) | Total Sugar (g) | Inverted Sugar (g) |
|---|---|---|---|---|---|
| Control | 43 | 4.4 | 4.6 | 52 | 9.0 |
| 0.1% | 38 | 6.0 | 6.6 | 52 | 12.6 |
| 0.2% | 34 | 8.8 | 9.6 | 52 | 18.4 |
| 0.3% | 25 | 12.1 | 12.8 | 51 | 25.0 |
| 0.4% | 14 | 18.7 | 19.2 | 52 | 37.8 |
| 0.5% | 4.4 | 23.7 | 24.0 | 52 | 47.8 |
| 0.6% | 1.3 | 25.5 | 25.5 | 52 | 51.0 |
| 0.7% | 0.9 | 25.5 | 25.5 | 52 | 51.0 |

The several advantages of the disclosed invention are listed below:

1. The quality of high test molasses obtained by disclosed method is superior compared with mineral acid treatment as caramel formation is substantially reduced.
2. Disclosed method requires lower retention time for inversion (up to 3 hours) than that of enzymatic method (8 to 10 hours).
3. The handling and use of methane sulphonic acid is easy and safe in the disclosed method.
4. Disclosed method provides substantial reduction in the capital cost due non-corrosive and eco-safe nature of methane sulphonic acid.
5. Disclosed method has efficiency of recovery of sugar at least 90% of theoretical.

Embodiments provided above give wider utility of the invention without any limitations as to the variations that may be appreciated by a person skilled in the art. A non-limiting summary of various embodiments is given above, which demonstrate the advantageous and novel aspects of the process disclosed herein.

We claim:

1. A method for the preparation of high test molasses from sugarcane or sugar beet juice comprising:

(a) concentrating said juice by evaporation to contain a higher amount of sucrose forming a concentrated syrup;

(b) adding a desired amount of organic acid to said syrup creating a reaction mixture; and (c) treating said reaction mixture at an effective temperature for about 2 to about 3 hours to cause inversion of sucrose to inverted sugar forming a high test molasses product, wherein the high test molasses product has a pH of about 3.

2. The method of claim 1, wherein said concentrated syrup comprises up to 50% by weight of sucrose.

3. The method of claim 1, wherein said organic acid is methane sulphonic acid.

4. The method of claim 3, wherein said organic acid is used between 0.2 to 0.4% by weight of concentrated syrup.

5. The method of claim 3, wherein said effective temperature ranges from about 75° C. to about 95° C.

6. The method of claim 1, wherein efficiency of conversion of said sucrose to inverted sugar is at least 90% by weight.

7. The method of claim 1, wherein efficiency of recovery of sugar in said high test molasses is above 90% of theoretical maximum value.

8. The method of claim 1, wherein said high test molasses has Brix value of at least 85°.

9. The method of claim 1, wherein the effective temperature is about 90° C.

10. The method of claim 1, wherein the juice comprises sugar beet juice.

11. The method of claim 1, wherein the juice comprises sugarcane juice.

* * * * *